US006450215B1

(12) United States Patent
Willemstyn et al.

(10) Patent No.: US 6,450,215 B1
(45) Date of Patent: Sep. 17, 2002

(54) APPARATUS AND METHOD FOR FILLING BAGS

(75) Inventors: Benjamin K. Willemstyn, Little Silver; Benjamin T. Holcombe, Silverton, both of NJ (US)

(73) Assignee: Charter Medical, Ltd., Winston-Salem, NC (US)

( * ) Notice: Subject to any disclaimer, the term of this patent is extended or adjusted under 35 U.S.C. 154(b) by 0 days.

(21) Appl. No.: 09/672,000

(22) Filed: Sep. 29, 2000

(51) Int. Cl.[7] ..... B65B 1/04; B65B 3/04

(52) U.S. Cl. ..... 141/10; 141/18; 141/100; 141/114; 141/237; 141/313

(58) Field of Search ..... 141/10, 18, 100, 141/113, 114, 234, 237, 238, 240, 248, 313, 314, 316, 325; 604/411–416, 52

(56) References Cited

U.S. PATENT DOCUMENTS

| | | | | |
|---|---|---|---|---|
| 1,017,369 A | | 2/1912 | Bates | |
| 2,830,396 A | | 4/1958 | Gowland | |
| 3,788,125 A | | 1/1974 | Kirschstein et al. | |
| 4,257,791 A | | 3/1981 | Wald | |
| 4,479,761 A | * | 10/1984 | Bilstad et al. | 417/395 |
| 4,754,786 A | | 7/1988 | Roberts | |
| 4,823,833 A | | 4/1989 | Hogan et al. | |
| 4,856,261 A | | 8/1989 | Hackett et al. | |
| 4,937,194 A | | 6/1990 | Pattillo et al. | |
| 5,261,466 A | | 11/1993 | Koyanagi | |
| 5,290,449 A | | 3/1994 | Heagle et al. | |
| 5,454,946 A | | 10/1995 | Heagle et al. | |
| 5,465,767 A | | 11/1995 | Harms et al. | |
| 5,614,412 A | | 3/1997 | Smith et al. | |
| 5,953,808 A | | 9/1999 | Schenck, Jr. et al. | |
| 6,079,462 A | * | 6/2000 | Martucci et al. | 141/236 |

* cited by examiner

*Primary Examiner*—Timothy L. Maust
(74) *Attorney, Agent, or Firm*—Birch, Stewart, Kolasch & Birch LLP

(57) ABSTRACT

An apparatus and method for filling bags achieves a substantially uniform fill level in bags. The apparatus includes a bag support that exerts pressure on the bags during filling of the bag such that the level of filling media among the bag is more evenly distributed. The apparatus and method also reliably maintain a sterile region during filling of bags by pressurizing the region before beginning bag filling operations.

20 Claims, 9 Drawing Sheets

APPARATUS AND METHOD FOR FILLING BAGS

BACKGROUND OF THE INVENTION

1. Field of the Invention

The present invention relates to an apparatus and method for filling bags with filling media. In particular, the present invention relates to an apparatus and method for accurately filling a plurality of bags to a desired level. The invention also relates to a method for maintaining a sterile region in a bag filling apparatus.

2. Description of the Background Art

A conventional apparatus 700 for filling flexible medical containers 704 is illustrated by FIG. 7. The apparatus 700 includes a carrier 702 for holding flexible medical containers 704. The flexible medical containers 704 are filled by a pump 706 which includes fluid supply containers 708. A load cell 710 supports the carrier 702 and detects a target weight indicating when the flexible medical containers 704 are filled to a desired level. U.S. Pat. No. 5,614,412 to Smith et al. discloses an apparatus for carrying flexible containers as illustrated in FIG. 7.

The conventional apparatus 700 has a disadvantage in that the flexible medical containers 704 are commonly supplied with fluid via a tubing junction 712. Therefore, physical variations in the tubing between the tubing junction 712 and the flexible medical containers 704 can result in a nonuniform distribution of fluid among the flexible medical containers 704. In addition, variations in the amount of fluid in the flexible medical containers 704 can result from differing amounts of air in the flexible medical containers 704, the orientation of the flexible medical containers 704 within the carrier 702, etc. The inability to evenly distribute fluid among the flexible medical containers 704 limits the accuracy to which each of the flexible medical containers 704 can be filled.

Another conventional apparatus 800 for filling bags is illustrated by FIG. 8. The apparatus 800 unwinds an elongated sheet 802 from a spool 803 and advances it through a closing means 804. The elongated sheet 802 is advanced by impellers 806, and individual filled bags 810 in the elongated sheet 802 are separated by a cutter 808. U.S. Pat. No. 5,261,466 to Koyanagi discloses an apparatus for filling bags as illustrated in FIG. 8.

The conventional apparatus 800 has the disadvantage that it requires a large area for operation. In addition, the closing means 804, the impellers 806, and the cutter 808 must be coordinated in order to ensure proper operation of the apparatus 800. The apparatus 800 therefore involves a complex interaction of the closing means 804, the impellers 806, and the cutter 808.

Still another conventional apparatus 900 for filling bags 904 is illustrated by FIG. 9. In the apparatus 900, a nutrient media container 902 supplies nutrient media to the bags 904 via a tubing network 906. A burette 908 is coupled to the tubing network 906 through a three-way valve 910, with the bags 904 being commonly supplied through a connector 912. U.S. Pat. 4,937,194 to Patillo et al. discloses an apparatus for filling bags as illustrated in FIG. 9. The conventional apparatus 900 has a disadvantage in that the tubing network 906 does not provide for uniform filling of the bags 904.

A need therefore exists for an apparatus and a method for filling bags in which bags can be filled to a substantially uniform level. Further, a need exists for an apparatus and a method for filling bags that accurately fills bags without being excessively large and complex. In addition, a need exists for an apparatus and a method for aseptically filling bags.

SUMMARY OF THE INVENTION

The present invention addresses the shortcomings of the conventional art and achieves other advantages not contemplated by the conventional art.

It is a primary object of the invention to provide an apparatus and a method for filling a plurality of bags to a substantially uniform level. Another primary object of the invention is to provide an apparatus and method for filling a plurality of bags that fills bags to a substantially uniform level without being excessively complex.

Another object of the invention is to provide an apparatus and method for filling bags in which sterility can be reliably maintained during bag filling operations.

A further object of the invention is to provide an apparatus and method for filling bags which can be operated to fill bags easily and time efficiently.

These and other objects of the invention are achieved by providing a bag filling apparatus for filling a plurality of bags comprising: a filling media source; tubing for fluidly connecting the filling media source to a plurality of bags; a pump for moving filling media through the tubing; and a support device for supporting the plurality of bags, the support device including a plurality of spaced walls, the spaced walls being constructed and arranged to exert pressure on side surfaces of bags held within the support device during filling of the bags.

In addition, these and other objects of the present invention are also accomplished by providing a bag filling apparatus for filling a plurality of bags comprising a filling media source; tubing for fluidly connecting the filling media source to a plurality of bags, the tubing including a first loop, a second loop, and at least one harness; a pump for moving filling media through the tubing; and at least one valve for selectively controlling filling media flow in the tubing.

Other objects of the invention are achieved by providing a method for filling a plurality of bags comprising: placing a plurality of bags within a support device, the support device having spaced walls arranged to exert pressure on sides of the bags during filling of the bags; fluidly connecting the plurality of bags to a filling media delivery system; and delivering filling media from the filling media delivery system to the plurality of bags, the spaced walls exerting pressure on the bags to substantially uniformly distribute filling media among the plurality of bags.

Further objects of the invention are achieved by providing a method for filling a bag comprising: fluidly connecting tubing to a filling media source; fluidly connecting the tubing to a bag; closing off a region of the tubing; pressurizing the closed off region with filling media; and opening a portion of the closed off region to allow filling media to flow into the bag.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
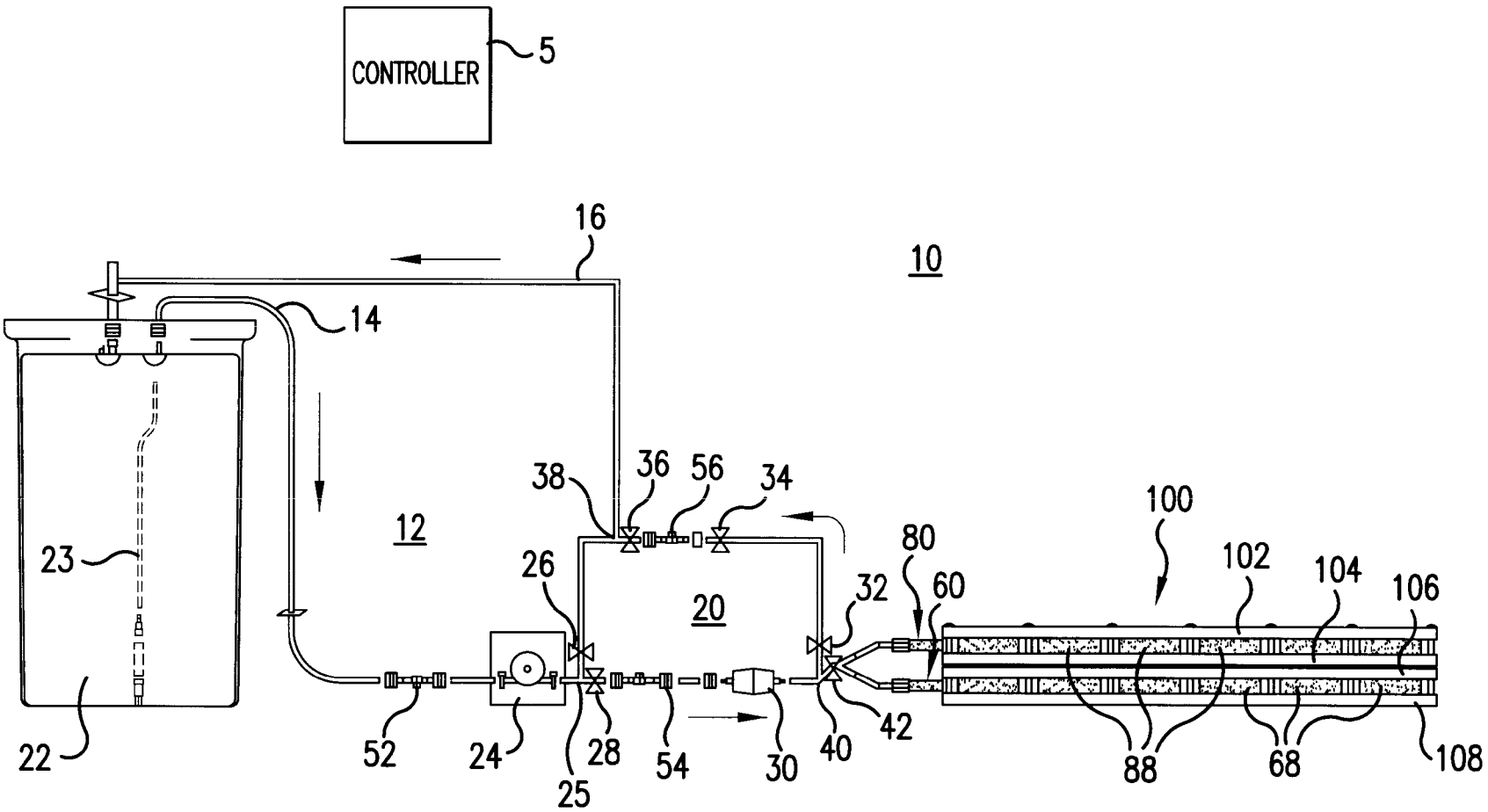
FIG. 1 is a view of a bag filling apparatus according to a first embodiment of the present invention.

FIG. 1 is a view of a bag filling apparatus 10 according to one embodiment of the present invention. In FIG. 1, the bag filling apparatus 10 is illustrated as generally including a controller 5, a first loop 12, a second loop 20, a container 22, a first harness 60, a second harness 80, and a bag support 100.

In the first loop 12, a process out leg 14 is in fluid communication with the container 22 via, for example, a dip tube 23 disposed within the container 22. The container 22 serves as a reservoir of filling media for the bag filling apparatus 10. The filling media may be, for example, sterile filtered solutions, biologic and non-biologic solutions, salt solutions, buffer solutions, culture media, etc.

The first loop 12 and the second loop 20 may be formed from sections of tubing. The tubing used in the bag filling apparatus 10 can be any arrangement of fluid-tight passageways. For example, flexible tubing, such as IV tubing, and silicone tubing, are suitable for use in the present invention.

Figure 2:
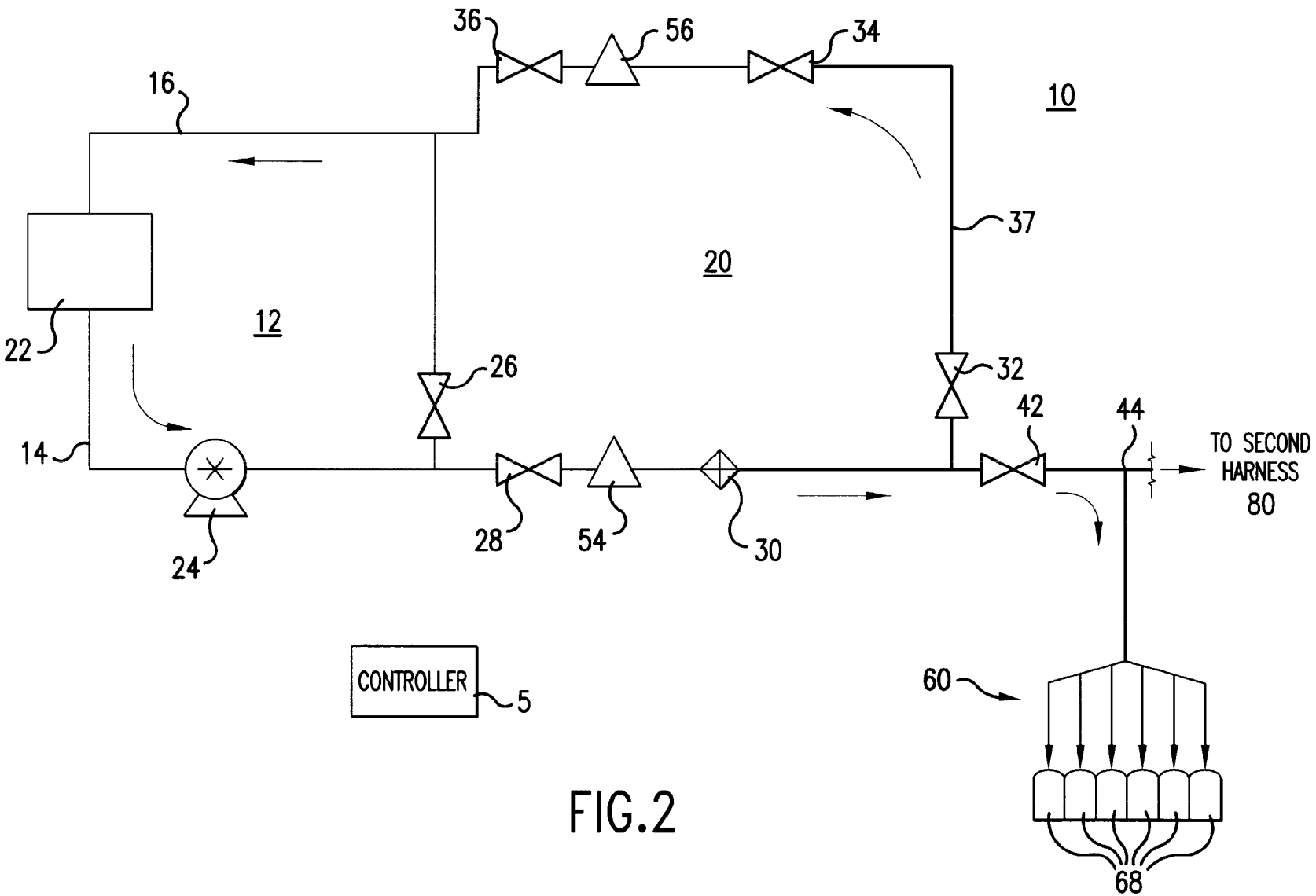
FIG. 2 is a schematic view of a bag filling apparatus according the first embodiment of the present invention.

The flow of filling media in the bag filling apparatus 10 is driven by a pump 24. The pump 24 pressurizes filling media supplied from the container 22 through the process out leg 14, to enable bag filling operations. The controller 5 may be operatively connected to the pump 24 for controlling the pump 24, and the controller 5 may also be operatively connected to the various valves included in the bag filling apparatus 10 in order to control the flow of filling media through the bag filling apparatus 10. The connections from the controller 5 to the pump 24, the valves, etc. are not shown in FIG. 1. In FIG. 2, an exemplary schematic connection from the controller 5 to the pump 24, and to one of the valves (the valve 26) is shown by dotted lines. The controller may be similarly connected to the remaining valves in the bag filling apparatus 10. The arrows in FIG. 1 indicate general flow directions of filling media through the bag filling apparatus 10.

The pump 24 supplies pressurized filling media to a connector 25, which may be, for example, a T-connector. The flows in branches of the connector 25 are selectively controlled by a valve 26 and a valve 28.

A filter 30 is disposed in series with the valve 28, and serves to filter filling media circulating in the second loop 20 and filling media supplied to the first and second harnesses 60, 80. Filling media filtered in the filter 30 next proceeds to a splitter 40, a first branch of the splitter 40 supplying filling media to the first harness 60 and the second harness 80 through a valve 42. The first and second harnesses 60, 80 are arranged to supply filling media to a plurality of bags 68 and 88, respectively, which are supported in the bag support 100. The bag support 100 is comprised of first through fourth plates 102, 104, 106, 108, which are spaced so as to exert pressure on the sides of the plurality of bags 68, 88 during filling of the bags 68, 88.

A second branch of the splitter 40 is provided to recirculate filling media in the second loop 20 through valves 32, 34 and 36. Filling media may then flow from the valve 36 to a connector 38, and then to the container 22 through a recycle leg 16.

The first loop 12 may include a connector 52 for allowing assembly/disassembly of the bag filling apparatus 10. Similarly, the second loop 20 may include connectors 54, 56 for assembly/disassembly of the bag filling apparatus. In FIG. 1, the connectors 52, 54 and 56 are illustrated as partially exploded for the purposes of illustration. A method of filling bags, in which assembly/disassembly steps are described, will be discussed below with reference to FIG. 2. The connectors 52, 54, 56 may be, for example, MPC quick disconnect type connectors.

The valves 26, 28, 32, 34, 36 and 42 may be, for example, electromagnetic pinch valves. The valves 26, 28, 32, 34, 36 and 42 may be electrically connected to the controller 5, the controller 5 selectively opening and closing the valves during bag filling operations.

A method of filling bags will now be discussed with reference to FIG. 2.

FIG. 2 is a schematic view of the bag filling apparatus 10 in accordance with one embodiment of the present invention.

During assembly of the bag filling apparatus 10, the sections of tubing comprising the first and second loops 12, 20 and the first and second harnesses 60, 80 are preferably connected to the valves in the bag filling apparatus 10 prior to connection of the tubing with the connectors 54, 56, etc. In particular, the section of tubing between the valve 34 and the valve 32 should first be connected to the valves 32, 34. This order of connecting is performed because when the valves 32 and 34 are connected to the section of tubing, they are arranged to partially or completely surround the tubing, a closing action of the valves 32, 34 resulting in a clamping or pinching of the exterior of the section of tubing, thereby closing off the interior of the section of tubing. The sections of tubing used to construct the bag filling apparatus 10 may advantageously include caps over their open ends, the caps being removable before assembly. Therefore, the valves 32, 34 can clamp off a sterile region of a section of tubing before the caps are removed. If the caps on the ends of the tube were removed prior to clamping by the valves 32, 34, the interior of the tube could be contaminated. Removal of the caps is required in order to connect a section of tubing with, for example, a connector 56, so this step should occur after connection of the tubing with the valves 32, 34.

When the bag filling apparatus 10 is assembled, the filling of the bags 68, 88 can begin. The operator of the bag filling apparatus controls the bag filling apparatus 10 from the controller 5. The controller 5 includes an operator interface (not shown) that allows the operator to input data into the controller 5 in order to facilitate filling of the bags 68, 88. Examples of the data utilized in filling the bags 68, 88 include the size and number of the bags 68, 88, the amount they are to be filled, the time required for filling the bags 68, 88, the flow rate of filling media generated by the pump 24, etc.

The controller 5 can include an electronic memory so that the bag filling operation may be automated. Alternatively, the operator can initiate opening and closing of the valves, the operation of the pump 24, etc., manually.

After the bag filling apparatus 10 is assembled, the pump 24 is calibrated. The pump 24 is calibrated by running the pump 24 with the valve 26 open, and the valves 28, 32, 34, 36, 42 closed, for a predetermined amount of time. A sensor (not shown) senses the volume of filling media pumped through the first loop 12 during the predetermined period of time. The sensor can be disposed anywhere in the first loop 12, such as within the pump 24. The sensed flow volume is divided by the predetermined amount of time in order to determine a flow rate of the pump 24. The flow rate of the pump 24 is used to determine the time required to fill the bags 68, 88.

The desired filling volume of the bags 68, 88 is entered into the controller 5 at the operator interface, and the controller 5 determines a time required to fill the bags 68, 88 to a desired level based upon the desired filling volume of the bags 68, 88 and the flow rate of the pump 24.

As an alternative to automated operation by a controller 5, the operator can perform manual calculations of flow rate and time required to fill the bags 68, 88.

Once the pump 24 is calibrated, and a required time for filling the bags is determined, the valve 26 is closed, and the valves 28 and 32 are opened. At this time, the valves 26, 34, 36, 42 are closed. Because the flow is restricted by the closed valves 26, 34, 36, 42, pressure builds up in the tubing between the pump 24 and the valve 34. The tubing forming the first loop 12 and the second loop 20 may be flexible, so energy may be stored by the elastic deformation of the tubing walls as the pump 24 runs. The pump 24 is run in this manner for a period sufficient to develop a sufficient pressure head in the tubing between the pump 24 and the valve 34, which may be, for example, about 2 seconds.

The pressure head between the pump 24 and the valve 34 is created so that a sterile region 37 can be maintained. The sterile region 37 in the second loop 20 is indicated by the bolded sections of tubing in FIG. 2. Because of the pressure head, once the valves 34 and 42 are opened during filling operations, there is little chance that filling media will flow upstream towards the valve 34 against the pressure head (clockwise in FIG. 2), or upstream towards the valve 42 (to the left in FIG. 2). This method of operating the bag filling apparatus provides a reliable method for maintaining the sterile region 37.

After the pressure head is created, the valves 34 and 36 are opened, and a steady flow is achieved through the filter 30. The steady flow, or "recycle flow" moves in a counterclockwise direction in FIG. 2, around the outside of the first loop 12 and the second loop 20. The direction of the recycle flow is indicated by the arrows adjacent the first and second loops 12, 20.

After the recycle flow is steady, the controller 5 simultaneously closes the valve 32 and opens the valve 42, with the pump 24 still running. At this time, filling media begins to flow through the valve 42 into the first harness 60 and the second harness 80 (not shown in FIG. 2). The controller 5 maintains the valve 42 open for the predetermined time period required to fill the bags, until the bags 68, 88 are filled to the desired level. The bags 68, 88 are in communication with one another through a splitter 44, and during filling of the bags 68, 88, the bag support 100 exerts pressure on the sides of the bags 68, 88. The pressure exerted by the bag support 100 facilitates uniform filling of the bags 68, 88.

After the predetermined time for filling the bags 68, 88 to a desired level has expired, and the bags 68, 88 of the first and second harnesses 60, 80 are filled to the desired level, the controller 5 closes the valve 42, and opens the valve 32. The valves 34 and 36 are also open at this time. The pump 24 may therefore continue to run after the bags 68, 88 are filled, with the flow of filling media being recycled to the container 22. As an alternative to opening the valve 32 and closing the valve 42 after the predetermined time for filling the bags 68, 88 to a desired level has expired, the valves 28 and 36 may be closed, and the valve 26 may be opened, allowing filling media to circulate through the first loop 12.

After the valve 42 is closed, the operator of the bag filling apparatus 10 waits for a short period of time to allow the pressure on the downstream side of the valve 42 (to the right of the valve 42 in FIG. 2) to equalize among the first and second harnesses 60, 80. Allowing the pressure to equalize among the first and second harnesses 60, 80 ensures that the amount of filling media in each of the bags 68, 88 is substantially uniform. The first and second harnesses 60, 80 and the bags 68, 88 are now ready for replacement.

Figure 5:
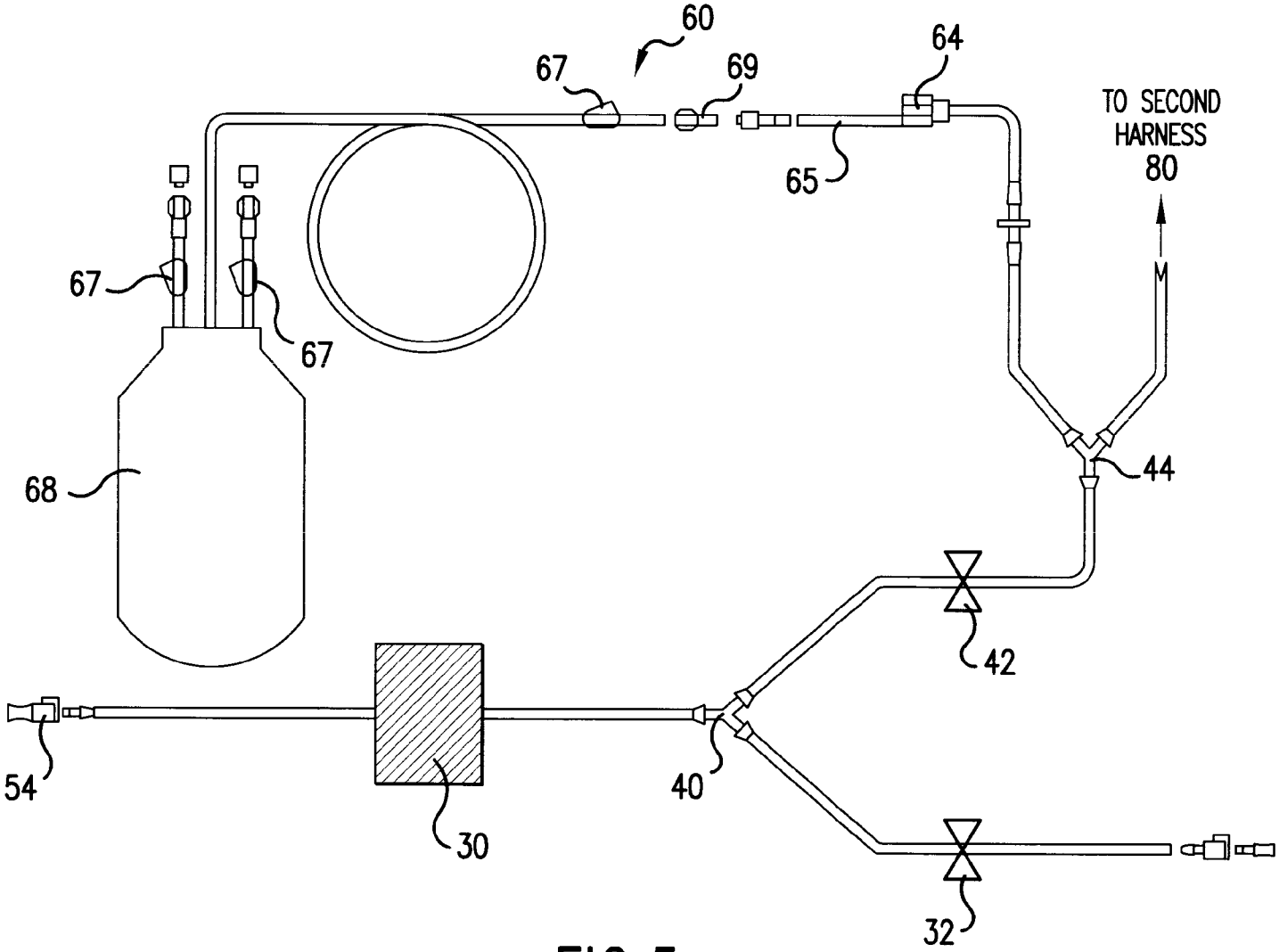
FIG. 5 is a view of a harness according to the present invention.

In order to replace the first and second harnesses 60, 80, the valves 28, 34, 36 may be closed and the valve 26 opened. After clamping (clamps 67 are shown in FIG. 5) the tubing connecting the bags 68, 88 to the first and second harnesses 60, 80, the bags 68, 88 of the first and second harnesses 60, 80 are removed from the bag support 100. The tubing in the first and second harnesses 60, 80 is clamped to ensure that the volume of filling media in the bags 68, 88 is maintained during disconnection of the first and second harnesses 60, 80 from the bag filling apparatus 10. An entire harness, such as harness 60, may be removed before beginning the filling of a new plurality of bags, or, individual bags, such as bags 68, can be removed at connector 69 (see FIG. 5), and replaced with empty bags. When new bags or new harnesses are connected to the bag filling apparatus 10, bag filling operations can begin again.

As an alternative to establishing a predetermined time period for filling the bags, a pressure sensor (not shown) can be included in the tubing of the bag filling apparatus 10, preferably downstream of the valve 42. A target pressure in the tubing of the harnesses 60, 80 can be determined that corresponds to a desired fill level for the bags 68, 88. The controller 5 can be connected to the pressure sensor, and can close the valve 42 and open the valve 32 when the target pressure is reached.

In calculating either the predetermined time for filling of the bags 68, 88, or a target pressure for the tubing of the first and second harnesses 60, 80, the operator must ensure that the bags 68, 88 are not overfilled. If the bags are overfilled, the pressure exerted by the bags 68, 88 against the interior walls of the bag support 100 may be too great, and the operator may not be able to remove the bags 68, 88 from the bag support 100.

According to the structure of the bag filling apparatus 10 and the method of operating the bag filling apparatus 10 illustrated by FIGS. 1 and 2, the sterile region 37 can be maintained through bag filling operations and through disassembly of the bag filling apparatus 10. The valves 34 and 42 can be closed during assembly/disassembly, and when the bag filling apparatus 10 is ready for bag filling operations, a pressure head is built up in the tubing forming the sterile region 37. Therefore, contaminated air or filling media is prevented from flowing into the strile region 37. The valve 26 is closed during filling operations, so a clockwise flow in the second loop 20 is avoided, which prevents unfiltered filling media from flowing back into the sterile region 37 through the valve 34.

According to the embodiment of a method of filling bags described above, the pump 24 may be run continuously from the calibration step until completion of bag filling operations. The pump 24 may also continue to run during disconnection of the first and second harnesses 60, 80, because the valve 42 is closed during this time. Therefore, time consuming startup and shutdown of the pump 24 may be avoided.

Although the bag filling method described above is described with reference to two harnesses, any number of harnesses can be used in bag filling operations without departing from the present invention. Further, each harness need not have six bags, and any number of bags can be included in each harness.

The structure of the bag support 100 will now be discussed.

Figure 3A:
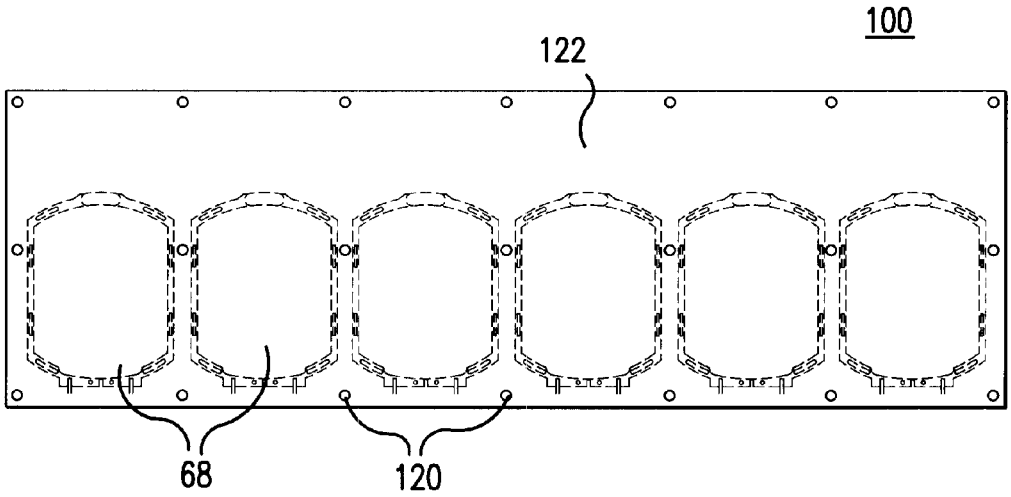
FIG. 3*a* is a top view of a bag support according the first embodiment of the present invention.
Figure 3B:
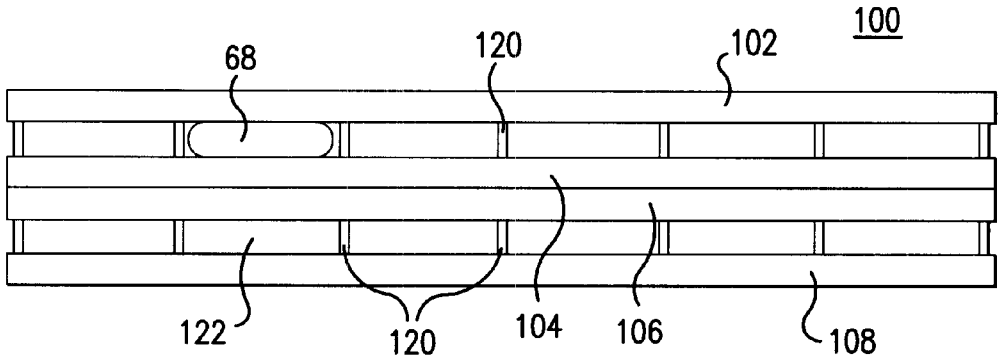
FIG. 3*b* is a front view of a bag support according the first embodiment of the present invention.

FIG. 3*a* is a top view of a bag support 100 according to one embodiment of the present invention, and FIG. 3*b* is a front view of the bag support 100. In FIG. 3*a*, the locations that bags 68 would occupy in the bag support 100 are indicated by hidden lines.

The bag support 100 may include first through fourth plates 102, 104, 106, 108. The first and second plates 102, 104 are separated by spacers 120, and the third and fourth plates 106, 108 are also separated by spacers 120.

The spacers 120 of the bag support 100 have a height determined so that when the bags held in the bag support 100 are being filled, the first through fourth plates 102, 104, 106, 108 exert pressure on the sides of the bags. Because the bags 68, 88 are in fluid communication with one another, the pressure on the sides of the bags 68, 88 facilitates uniform filling of the bags 68, 88. The spacers 120 and the first through fourth plates 102, 104, 106, 108 may be constructed to dimensional tolerances such that the volume of filling media in the bags 68, 88 can be achieved, for example, to within 1% of bag volume.

The first through fourth plates 102, 104, 106, 108 and the spacers 120 define a plurality of slots 122, each slot 122 accommodating one of the bags 68, 88. The term "slot" as utilized in this specification is intended to identify the space between a pair of spaced plates that is arranged so as to accommodate one of the bags 68, 88.

The first through fourth plates 102, 104, 106, 108 may be constructed of rigid materials, such as aluminum, steel, or other alloys. Synthetic materials, such as plastics, may also be used, if they possess sufficient rigidity to exert a substantially uniform pressure on the bags 68, 88. The spacers 120 may also be constructed of a rigid material, such as steel. When the bags in the bag support 100 are filled to near capacity, a large pressure is exerted by the bags on the spacers 120 and the first through fourth plates 102, 104, 106, 108, so the material used in the bag support 100 should be sufficiently strong to withstand the pressure exerted by the bags 68, 88. In FIG. 3*b*, an exemplary bag 68 is illustrated in a filled state.

The bag support 100 may be provided with variously sized spacers 120 so that bags of differing thickness may be accommodated and filled with a high degree of accuracy. In addition, the bag support 100 can include plates with differing intervals between spacers 120, creating slots 122 of differing length and width. While the spacers 120 are illustrated as cylindrical, they can have differing cross-sections. Alternatively, a continuous structure, with slots formed therein, could be disposed between the first through fourth plates 102, 104, 106, 108, to space apart the first through fourth plates 102, 104, 106, 108.

Although the bag support is illustrated as having four plates for accommodating the bags 68, 88 of two harnesses 60, 80, a greater or lesser number of plates could be provided for accommodating one or more harnesses. Also, while the second and third plates 104, 106 are illustrated as separate plates, they could be formed as a single plate.

In the figures, the first through fourth plates 102, 104, 106, 108 are illustrated as oriented horizontally. However, the first through fourth plates 102, 104, 106, 108 may be oriented vertically, or obliquely with respect to vertical.

Figure 4A:
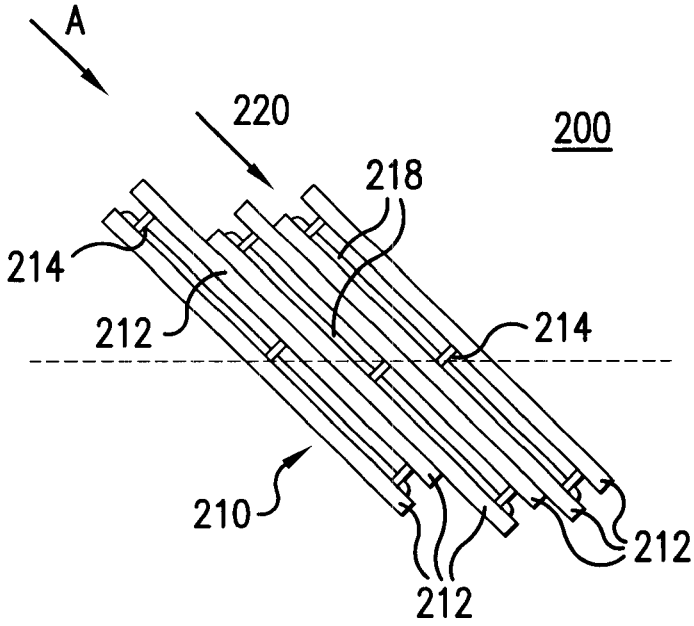
FIG. 4*a* is an end view of a bag support according a second embodiment of the present invention.
Figure 4B:
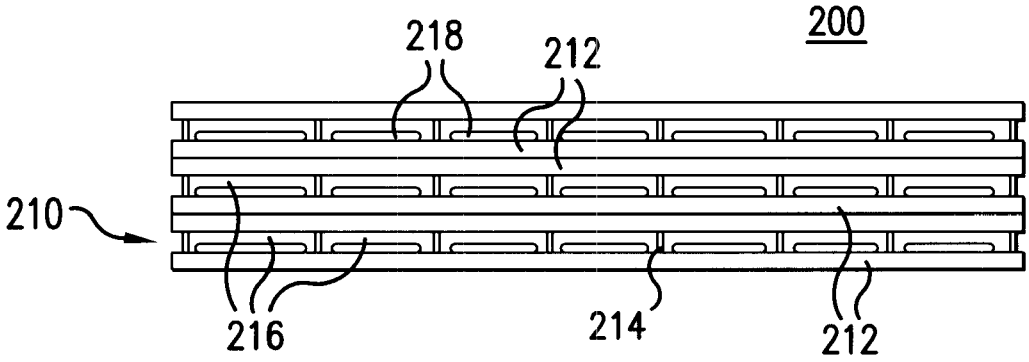
FIG. 4*b* is a view of the bag support illustrated in FIG. 4*a* as seen from the direction of arrow A in FIG. 4*a;*

FIG. 4*a* is an end view of a variant bag support 200 according to an embodiment of the invention. FIG. 4*b* is a view of the bag support 200 in the direction of arrow A. The bag support 200 includes a plurality of pairs 210 of spaced plates 212 separated by spacers 214. The spaced plates 212 and the spacers 214 form a plurality of slots 216 for accommodating bags 218. The bags 218 may be inserted into the bag support 200 in the direction of the arrow 220. In FIGS. 4*a* and 4*b*, the bags 218 have not yet been filled, and, the tubing connecting the bags 218 to the remainder of the bag filling apparatus 10 are not illustrated. When the bags 218 have been filled to a desired level, sides of the bags 218 will abut and exert pressure on the interior walls of the plates 212 forming its respective slot 216.

In FIGS. 4*a* and 4*b*, the bag support 200 is illustrated as having three rows of seven slots 216. This is an exemplary number of rows and slots, and any combination of rows and slots may be utilized.

The bag support 200 supports bags 218 between the plates 212 obliquely to vertical, and the bags 218 may be arranged in the bag support 200 such that a longitudinal center portion of the bags are at approximately the same height. The approximate location of a longitudinal center of the bags is illustrated by a dashed line in FIG. 4*a*. Because all of the bags 218 supported in the bag support 200 are at approximately the same height, a more uniform distribution of filling media can be achieved in the bags 218, because there is no pressure differential (i.e. "gravity head") created between the bags 218 disposed in the bag support 200.

In FIGS. 4*a* and 4*b*, the plates 212 in the pairs 210 that abut an adjacent plate 212 can instead be a single plate. In this configuration, the bag support 200 could be constructed using only four plates, one on each end of the bag support 200, and two on the interior of the bag support 200.

The structure of the first and second harnesses 60, 80 will now be described.

FIG. 5 is a partially exploded view of the first harness 60 according to an embodiment of the present invention. In order to simplify the illustration, the second harness 80 is omitted and only one bag 68 of the first harness 60 is shown.

The second loop 20 is in fluid communication with the first and second harnesses 60 and 80 via the valve 42. A splitter 44 divides the flow of filling media from the valve 42 for supplying filling media to the first and second harnesses 60, 80. The first harness 60 may include a splitter 64 for supplying filling media to a plurality of bags 68. In FIG. 4, the splitter 64 is a six-way splitter for supplying six bags 68 via supply tubes 65 (only one shown in FIG. 5), although any number of bags 68 can be included in the harness 60.

Clamps 67 are included on the tubing connecting the bag 68 to the splitter 64. The clamps 67 may be used to close the flow of filling media from the bag 68 after the bag 68 is filled. The connector 69 is interposed between the splitter 64 and the bag 68 to facilitate removal of the bag 68 from the harness 60.

The remaining bags 68 in the harness 60 can be similarly arranged in the harness 60, and the second harness 80 can have a structure similar to that of the first harness 60. If the second harness 80 is identical to the first harness 60, the cost of the bag filling apparatus 10 may be reduced as only one type of harness is required.

Figure 6:
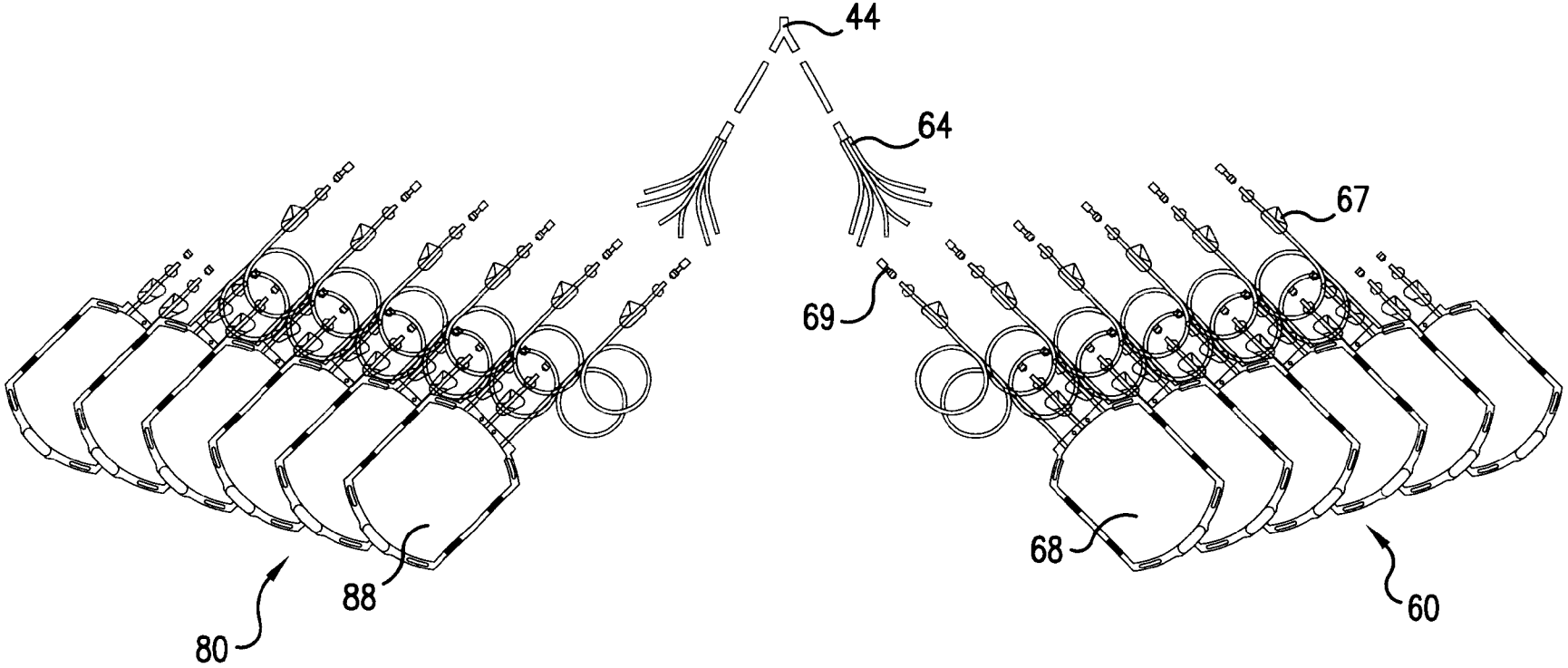
FIG. 6 is an exploded view of harnesses according to the present invention.
Figure 7:
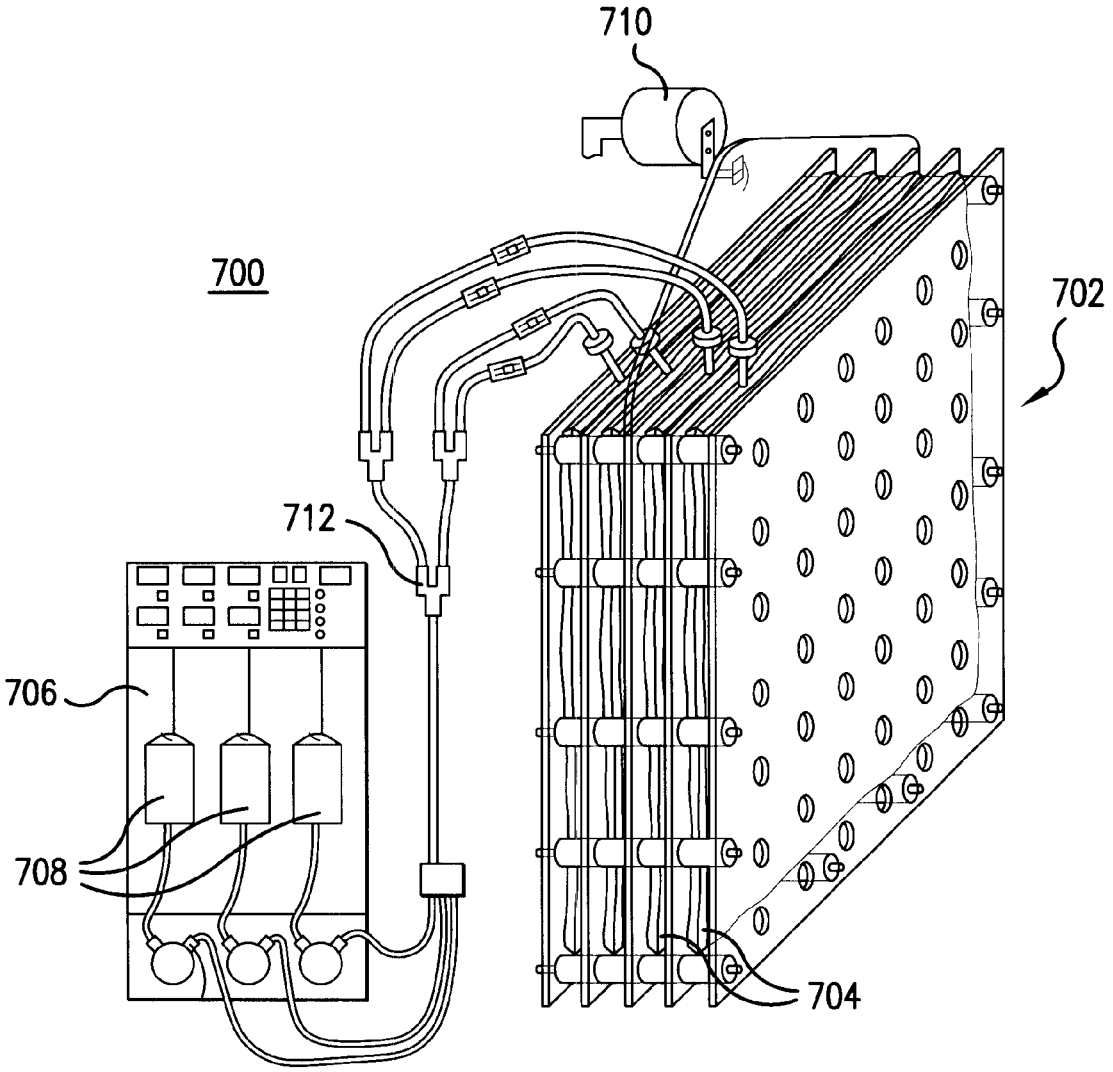
FIG.7 CONVENTIONAL ART
FIG. 7 is a view of a conventional apparatus for filling flexible medical containers.
Figure 8:
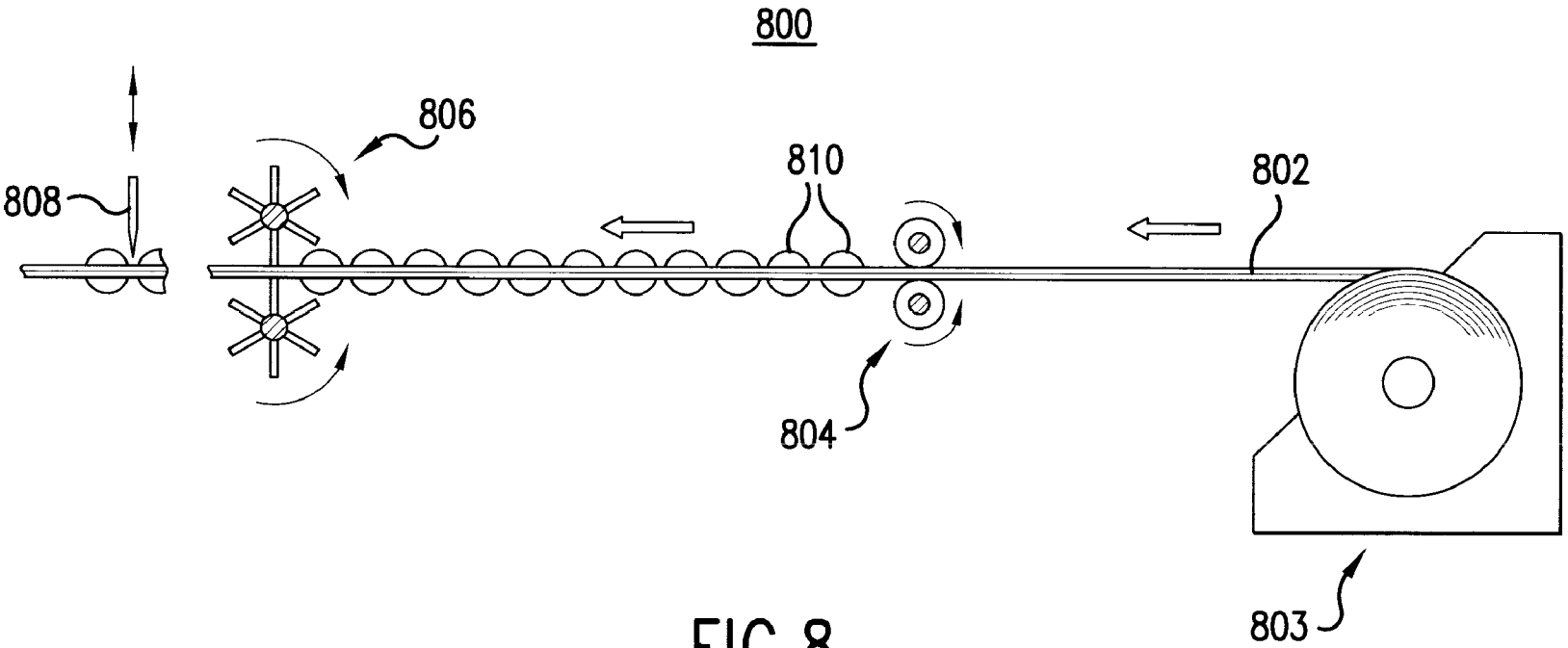
FIG.8 CONVENTIONAL ART
FIG. 8 is a view of a conventional apparatus for filling bags.
Figure 9:
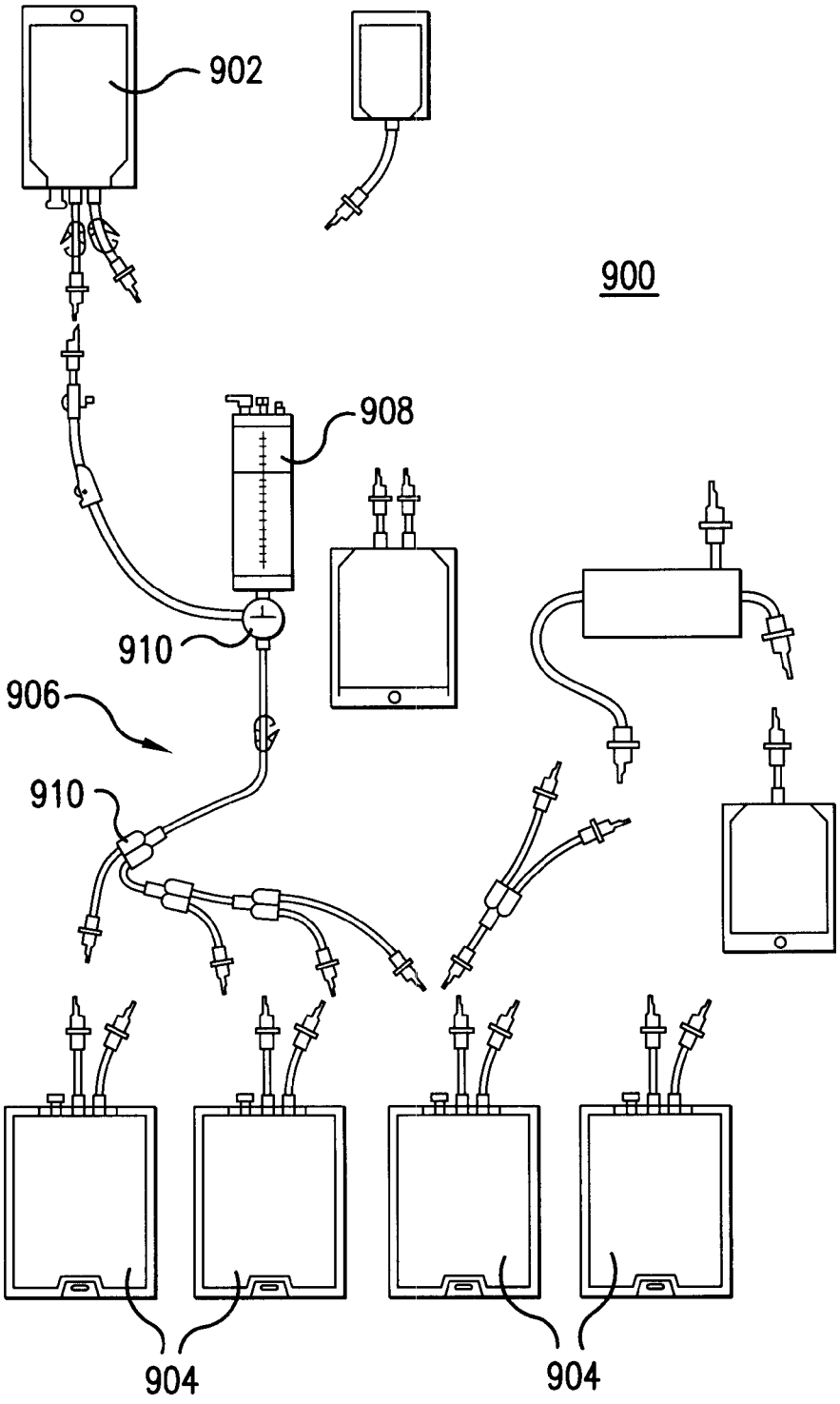
FIG.9 CONVENTIONAL ART
FIG. 9 is a view of a conventional apparatus for filling bags.

FIG. 6 is an exploded view of the first and second harnesses 60, 80. In the exemplary embodiment illustrated by FIG. 6, the first harness 60 includes six bags 68 and the second harness 80 includes six bags 88. This arrangement is used for the purpose of illustration, and any number of bags could be used in the first and second harnesses 60, 80.

First and second harnesses 60, 80 are disclosed in the embodiments illustrated in FIGS. 1–5. However, two harnesses need not be used, and any number of harnesses could be supplied with filling media by the second loop 20. For example, one or three or more harnesses could be connected to the splitter 44 by utilizing a three-way, a four-way, etc. splitter 44.

The bags 68, 88 filled by the bag filling apparatus 10 can be any flexible fluid-tight bag. For example, 600 or 800 mL bags for storing blood, culture media, sterile solutions, etc. could be filled by the bag filling apparatus 10. Alternate bag sizes can also be used, with variations in the size of the bag support 100, the capacity of the pump 24, the capacity of the first loop 12 and the second loop 20, etc. being within the scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bag filling apparatus for filling a plurality of bags, the apparatus comprising:

a filling media source;

tubing for fluidly connecting the filling media source to a plurality of bags, the tubing including a first loop, a second loop, and at least one harness;

a pump for moving filling media through the tubing; and at least one valve for selectively controlling filling media flow in the tubing, wherein the filling media source and the pump are in the first loop, and wherein the second loop and the first loop share a common line, the at least one valve including a valve for directing flow in the common line.

2. The bag filling apparatus of claim 1, further comprising a support device for supporting the plurality of bags, the support device including a plurality of spaced walls, the walls being constructed and arranged to exert pressure on side surfaces of bags held within the support device during filling of the bags.

3. The bag filling apparatus of claim 1, wherein the harness is fluidly connected to the second loop, a first valve in the second loop being operable to selectively allow filling media flow towards a point where the harness is connected to the second loop, and a second valve in the second loop being operable to selectively allow filling media flow away from the connection point.

4. The bag filling apparatus of claim 3, further comprising a filter located in the second loop between the first valve and the connection point.

5. A bag filling apparatus for filling a plurality of bags, the apparatus comprising:

a filling media source;

tubing for fluidly connecting the filling media source to a plurality of bags, the tubing including a first loop, a second loop, and at least one harness;

a pump for moving filling media through the tubing; and at least one valve for selectively controlling filling media flow in the tubing, wherein the harness is fluidly connected to the second loop, a first valve in the second loop being operable to selectively allow filling media flow towards a point where the harness is connected to the second loop, and a second valve in the second loop being operable to selectively allow filling media flow away from the connection point.

6. The bag filling apparatus of claim 5, further comprising a support device for supporting the plurality of bags, the support device including a plurality of spaced walls, the walls being constructed and arranged to exert pressure on side surfaces of bags held within the support device during filling of the bags.

7. The bag filling apparatus of claim 5, wherein the filling media source and the pump are in the first loop.

8. The bag filling apparatus of claim 5, further comprising a filter located in the second loop between the first valve and the connection point.

9. A method of filling a bag comprising:

fluidly connecting tubing to a filling media source;

fluidly connecting the tubing to a bag;

closing off a region of the tubing;

pressurizing the closed off region with filling media; and opening a portion of the closed off region to allow filling media to flow into the bag, wherein the tubing includes a first loop and a second loop, the step of closing off a region of the tubing including closing a valve interposed between the bag and the second loop, wherein the two loops share a common leg, the step of closing off a region of the tubing including closing a valve in the common leg.

10. The method of claim 9, further comprising placing the bag within a support device prior to filling the bag, the support device having spaced walls positioned to exert pressure on sides of the bag during filling of the bag.

11. The method of claim 9, further comprising:

providing a pump in the first loop for pressurizing the filling media; and providing a filter in the second loop in a fluid flow path between the pump and the bag.

12. The method of claim 11, wherein the filter is disposed in a supply side of the second loop, the second loop further including a recycle side, the supply side and the recycle side being located on either side of a point of intersection of the second loop and a connector fluidly connecting the second loop to the bag.

13. The method of claim 12, wherein the step of closing off a region of the tubing includes closing a valve in the recycle side of the second loop.

14. The method of claim 13, further sing prior to opening a portion of the closed off region to allow filling media to flow into the bag, opening the valve in the recycle side of the second loop to establish a recycle flow in the second loop.

15. A method of filling a bag comprising:

fluidly connecting tubing to a filling media source;

fluidly connecting the tubing to a bag;

closing off a region of the tubing;

pressurizing the closed off region with filling media; and opening a portion of the closed off region to allow filling media to flow into the bag, further comprising:

providing a pump in the first loop for pressurizing the filling media; and providing a filter in the second loop in a fluid flow path between the pump and the bag.

16. The method of claim 15, further comprising placing the bag within a support device prior to filling the bag, the support device having spaced walls positioned to exert pressure on sides of the bag during filling of the bag.

17. The method of claim 15, wherein the tubing includes a first loop and a second loop, the step of closing off a region of the tubing including closing a valve interposed between the bag and the second loop.

18. The method of claim 17, wherein the filter is disposed in a supply side of the second loop, the second loop further including a recycle side, the supply side and the recycle side being located on either side of a point of intersection of the second loop and a connector fluidly connecting the second loop to the bag.

19. The method of claim 18, wherein the step of closing off a region of the tubing includes closing a valve in the recycle side of the second loop.

20. The method of claim 19, further comprising prior to opening a portion of the closed off region to allow filling media to flow into the bag, opening the valve in the recycle side of the second loop to establish a recycle flow in the second loop.

* * * * *